US007290581B2

(12) United States Patent
Lee

(10) Patent No.: US 7,290,581 B2
(45) Date of Patent: Nov. 6, 2007

(54) HALF SPREAD FOLDING DOOR

(76) Inventor: Wan Young Lee, 103-202 Gwanak Hyeondae Apt., 1000 Bongcheon 3-dong, Gwanak-gu, Seoul 151-755 (KR)

( * ) Notice: Subject to any disclaimer, the term of this patent is extended or adjusted under 35 U.S.C. 154(b) by 496 days.

(21) Appl. No.: 10/672,105

(22) Filed: Sep. 26, 2003

(65) Prior Publication Data

US 2005/0022949 A1 Feb. 3, 2005

(30) Foreign Application Priority Data

Jul. 28, 2003 (KR) ..... 10-2003-0051934

(51) Int. Cl.
*E06B 3/48* (2006.01)

(52) U.S. Cl. ..... 160/183; 160/89; 16/381

(58) Field of Classification Search ..... 160/183, 160/196.1, 199, 206, 89, 25.08, 126, 348, 160/88; 16/381, 363
See application file for complete search history.

(56) References Cited

U.S. PATENT DOCUMENTS

| | | | | |
|---|---|---|---|---|
| 2,351,656 | A * | 6/1944 | Auten | 160/199 |
| 2,976,923 | A * | 3/1961 | Hirashiki | 160/229.1 |
| 3,040,806 | A * | 6/1962 | Bennett et al. | 160/199 |
| 3,131,753 | A * | 5/1964 | Dixon | 160/183 |
| 3,236,289 | A * | 2/1966 | Dixon | 160/231.2 |
| 3,348,628 | A * | 10/1967 | Dixon et al. | 181/287 |
| 3,708,009 | A | 1/1973 | Viol et al. | 160/84 |
| 3,850,223 | A * | 11/1974 | Tompkins | 160/84.08 |
| 3,908,731 | A | 9/1975 | Runka | 160/231 |
| 4,387,760 | A | 6/1983 | Greschbach | 160/229 |
| 4,452,293 | A | 6/1984 | Gorse | 160/232 |
| 4,460,030 | A | 7/1984 | Tsunemura et al. | 160/35 |
| 4,582,109 | A * | 4/1986 | Fairbanks | 160/84.04 |
| 5,472,037 | A * | 12/1995 | Hoffman | 160/183 |

FOREIGN PATENT DOCUMENTS

| | | |
|---|---|---|
| EP | 1088959 | 4/2001 |
| KR | 20-0227782 | 4/2001 |
| KR | 2002-0028596 | 4/2002 |
| KR | 20-0318037 | 6/2003 |

* cited by examiner

*Primary Examiner*—Blair M. Johnson
(74) *Attorney, Agent, or Firm*—Sheridan Ross P.C.

(57) ABSTRACT

A half spread folding door is comprised of plural door leaves; door frames supporting each door leaf in both side ends thereof; a hinge means for connecting successively each door leaf with adjacent door leaf along its width direction, a pair of hinge means are lengthwise each mounted in both side ends of the door leaf and plural hinge means are lengthwise mounted in the middle of the door leaf, allowing each door leaf to be rotated around a hinge shaft correlatively, and for folding each door leaf toward alternative dead end of the door leaves sequentially; and a spread confining means for limiting relative rotation angles of every door leaves interconnected by the hinge means and a spread range of each door leaf in an angle of 30° to 60° to configure as the form of zigzag when the door leaves are spread. Each door leaf has a form of zigzag when closed, a thinner thickness door than a conventional flat type folding door can be configured using the same property material, which attains the very lighter but highly rigid door. The door can be easily opened/closed and the door leaves can be smoothly folded during its opening operation, adapting to use an opening of large structure or a foldable roof such as large depot and an airshed, etc.

6 Claims, 16 Drawing Sheets

HALF SPREAD FOLDING DOOR

BACKGROUND OF THE INVENTION

1. Field of the Invention

The present invention relates to a folding door for opening/closing the entrance of all sorts of structure. More particularly, the invention relates to a half spread folding door wherein the door has a form of zigzag when it is fully opened, and the door has relative light weight and excellent rigidity so that it can be utilized at the entrance of large structure such as large depot and an airshed, etc.

2. Description of the Prior Art

Generally, since a large structure such as a depot of a grand scale logistic system, a warehouse of various industrial supplies, or an airshed must keep large articles, its entrance should be very large and its door has an extra large size which varies from several meters to a dozen meters in its width and height. Therefore, the door should have from several hundred kg to several ton in its weight, and its smooth opening/closing is a necessity and its high rigidity is required to resist an external force like a wind force.

Such a door can be employed as a sliding door for being thrust in a right/left direction, a folding door for being folded when opened and for being spread when closed, a swing door for being opened/closed centering around a shaft installed at one end of the door, and a shutter for being rolled up when opened and for being unfolded when closed.

However, it is very difficult for a swing door to adapt to an entrance of a large structure having very large size and heavy weight owing to its structural characteristic. Further, a sliding door, a folding door, and a shutter could be applied to an entrance of the large structure, but generally all of them must be operated by rotation force of a motor.

For instance, in Korean patent Laid-Open No. 2002-0028596, a sliding door for an airshed is described in which plural door members having suitable size are slidingly coupled to each other in an overlapping manner and are extended or shortened like a telescope. Further, in Korean Utility Model Registration No. 20-0227782, a sliding door is described in which plural door members are hingedly connected serially to move with a bending manner into a wall of an airshed or pull out from a wall of an airshed.

Furthermore, European Patent EP 1088959 A1 describes a folding door in which plural door leaves are hingedly connected serially to be folded or spread in a form of zigzag. More, Korean Utility Model Registration No. 20-0318037 describes a folding shutter in which plural slates are hingedly connected serially to be rolled up and unfolded in a form of zigzag.

However, in the conventional doors, each face of a door leaf is positioned on the same plane or the same direction and a rigidity of a door depends wholly on a materiality and thickness of the door. Thus, the door must be manufactured with a very deep thickness to secure the rigidity against an external force like a wind force and it leads to a problem in which a motor must require high consumption power to run a heavy weight door.

Further, as each door member is placed on the same plane when a conventional folding door is fully spread, relative high force is needed to fold the fully spread door and it is hard to make a folding operation smooth.

Particularly, in the case of a telescopic sliding door which is popular to an entrance of a large structure, the entrance has a big size and it calls for many door leaves. The horizontal cross-section of a door, which is necessary to operate a door, should be increased in proportion with a thickness of a door. It has a problem in that the door has occupied in a large space.

SUMMARY OF THE INVENTION

Accordingly, the present invention has been made with taking the above problems occurring in the prior art into consideration, and an object of the present invention is to provide a half spread folding door in which the thin thickness half spread folding door can be configured using the same property material, which attains a very lighter but highly rigid door, thus easily adapting to an opening of large structure or a foldable roof such as large depot and an airshed, etc.

Another object of the present invention is to provide a half spread folding door in which the door can be easily opened/closed with little force and also the door leaves can be smoothly folded when in its opening operation.

Another object of the present invention is to provide a half spread folding door in which the door can be operated at an installation area corresponding to a width of a door leaf, irrespective of a size of opening or a number of door leaves.

In order to accomplish the above object, a half spread folding door comprises plural door leaves having a predetermined width and length; door frames supporting each door leaf in both side ends thereof; a hinge means for connecting successively each door leaf with adjacent door leaf along its width direction, allowing each door leaf to be rotated around a hinge shaft correlatively, and for folding each door leaf toward alternative dead end of the door leaves sequentially; and a spread confining means for limiting relative rotation angles of every door leaves interconnected by the hinge means and a spread range of each door leaf in 30° to 60° to configure as the form of zigzag when the door leaves are spread.

Further, according to the desirable characteristic of the present invention, the spread confining means is comprised of a first hinge cylinder established at one side end of the door leaf and enabling the hinge shaft go through, and having a first notch at a lower portion of the first hinge cylinder, the first notch having a form of a cut-off in a predetermined angle around an axis of the first hinge cylinder; a second hinge cylinder established at an adjacent side end of the adjacent door leaf to the door leaf and enabling the hinge shaft go through, and having a second notch at an upper portion of the second hinge cylinder, the second notch having a form of a cut-off in a predetermined angle around an axis of the second hinge cylinder, the notch angle being the same as one of the first notch, but overlapping in only certain value; and a stopper attached on the hinge shaft to nest in the overlap portion, restricting the rotation of each door leaf coupled with the hinge shaft.

Furthermore, according to another desirable characteristic of the present invention, the spread confining means is comprised of a stopper that is installed at respective hinge end of a pair of door leaves coupled by the hinge means or at a hinge end of only one door leaf.

More, according to another desirable characteristic of the present invention, the spread confining means is comprised of a flexible wire or rope or sheet which connects with free end of a pair of door leaves coupled with the hinge means.

A pair of hinge means 20 are each mounted lengthwise in both side ends of the door leaf 10 and plural hinge means 20 are mounted lengthwise in the middle of the door leaf 10.

Accordingly, in the inventive half spread folding door, each door leaf has a form of zigzag when closed, a thinner thickness door than a conventional flat type folding door can be configured using the same property material, which attains the very lighter but highly rigid door.

Further, since each door leaf can not fully spread, the door can be easily opened/closed with little force and also the door leaves can be smoothly folded when its opening operation, which adapts to use an opening of large structure or a foldable roof such as large depot and an airshed, etc.

Further, the present invention has an excellent effect in that structural stability and an improvement in confidence can be contributed.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENTS

Figure 1:
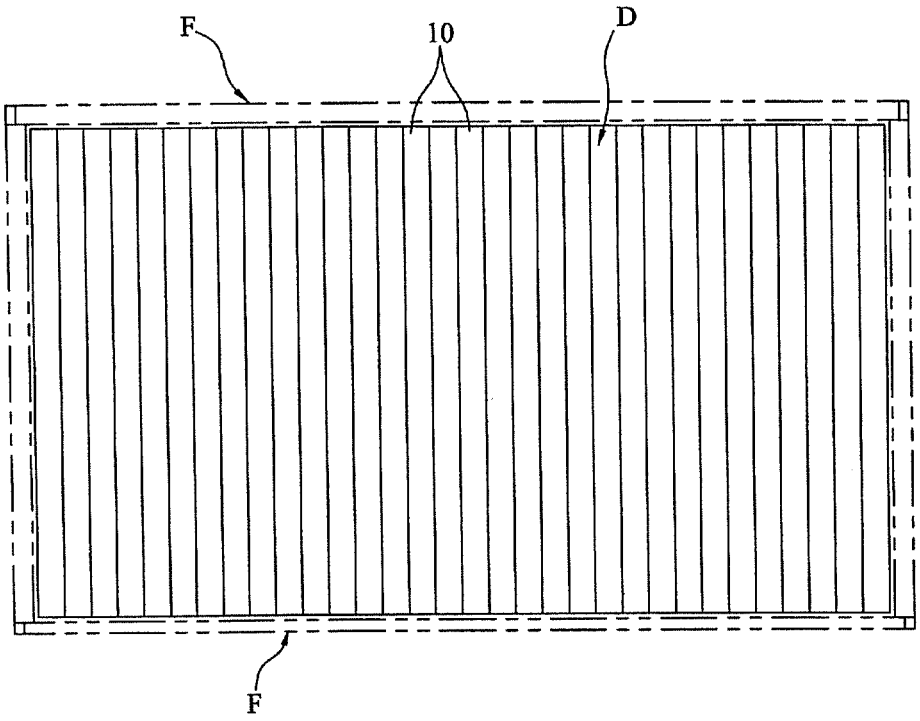
FIG. 1 is a front view of a half spread folding door according to one embodiment of the present invention.
Figure 2:
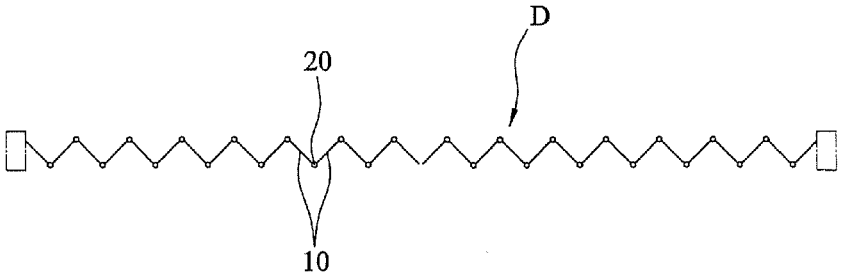
FIG. 2 is a top plan view of FIG. 1.
Figure 3A:
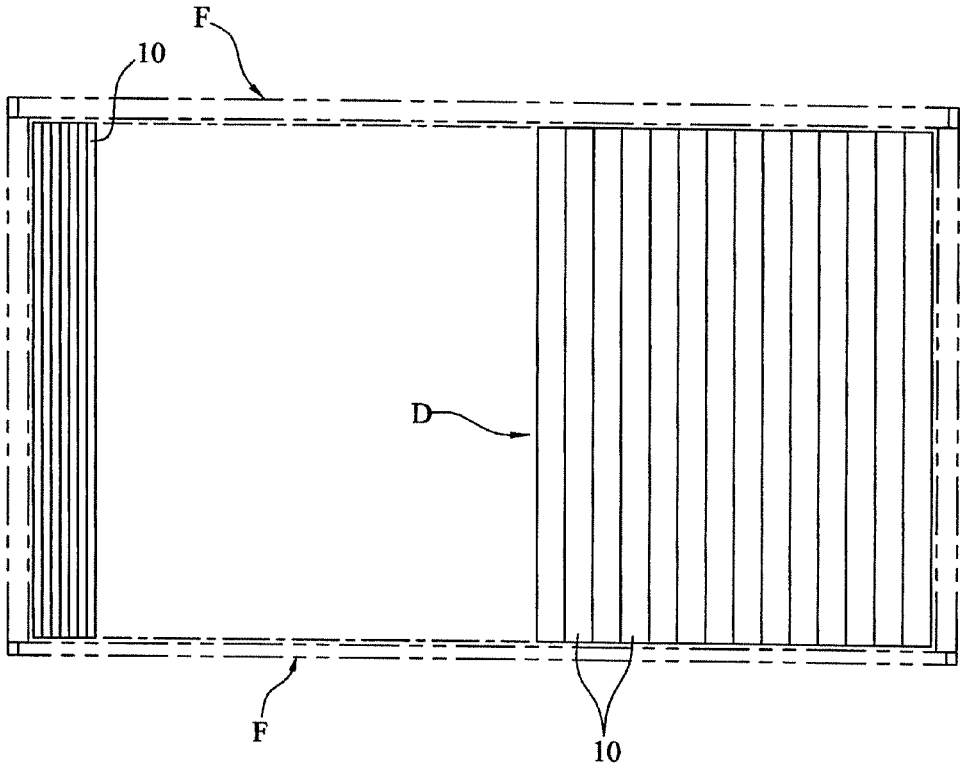
FIGS. 3A and 3B are a front view and a top plan view showing the folding state of a half spread folding door according to the present invention, respectively.
Figure 3B:
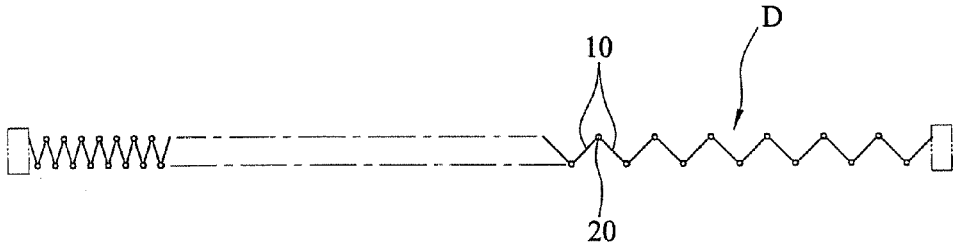
Figure 4:
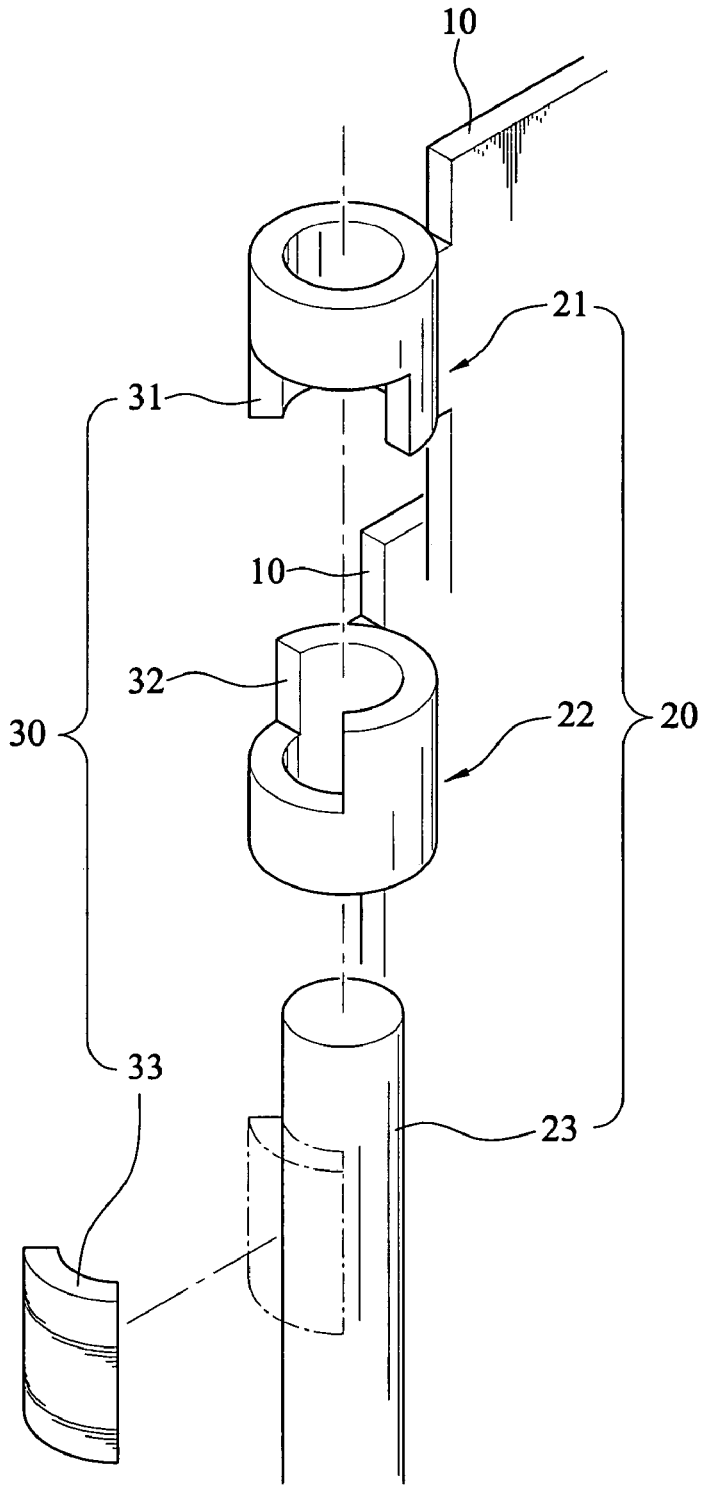
FIG. 4 is a disassembled perspective view showing a spread confining means according to a first embodiment.
Figure 5:
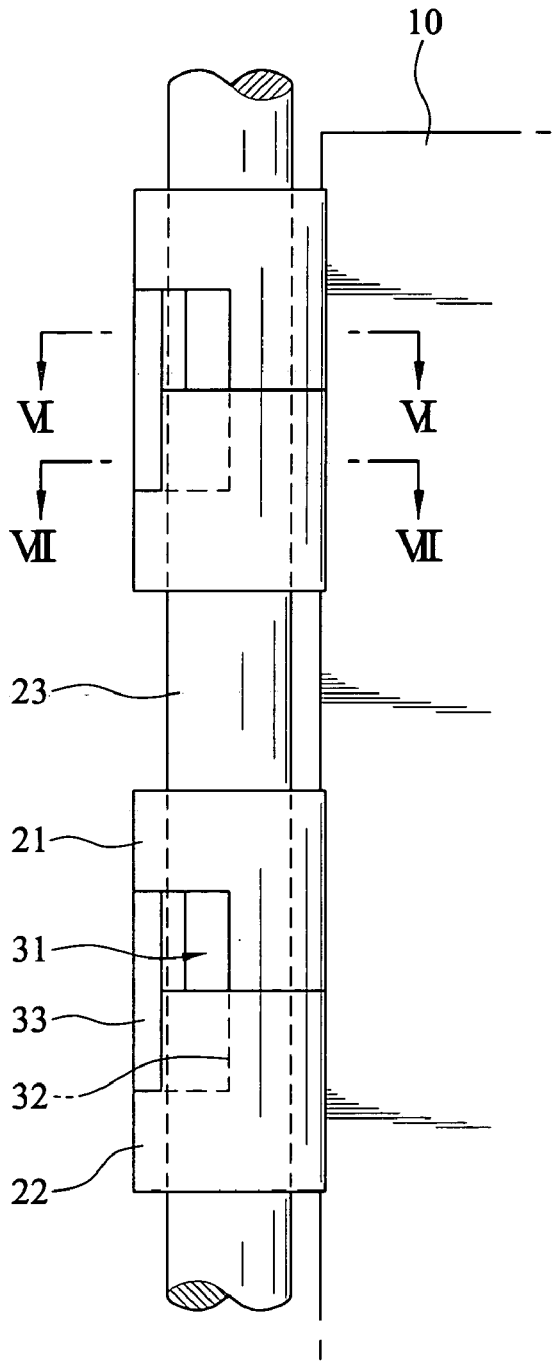
FIG. 5 is an assembled side view of FIG. 4.
Figure 6A:
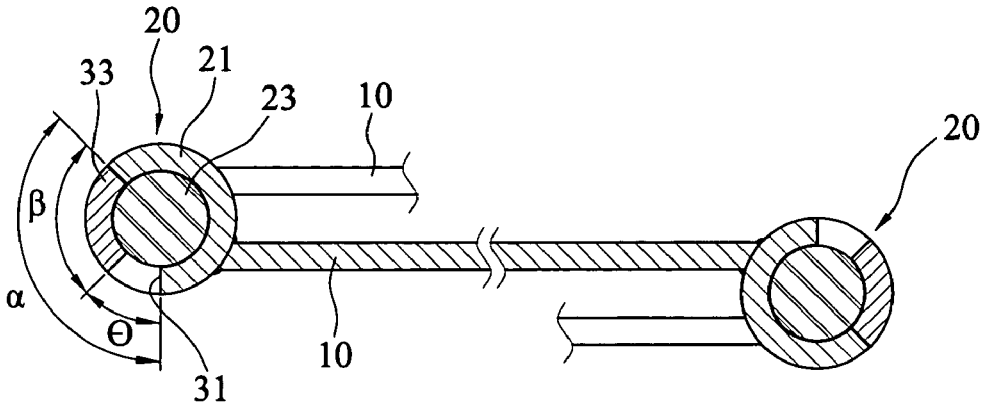
FIGS. 6A and 6B are sectional views showing a folding state and a spread state of the door leaves along line VI-VI of FIG. 5, respectively.
Figure 6B:
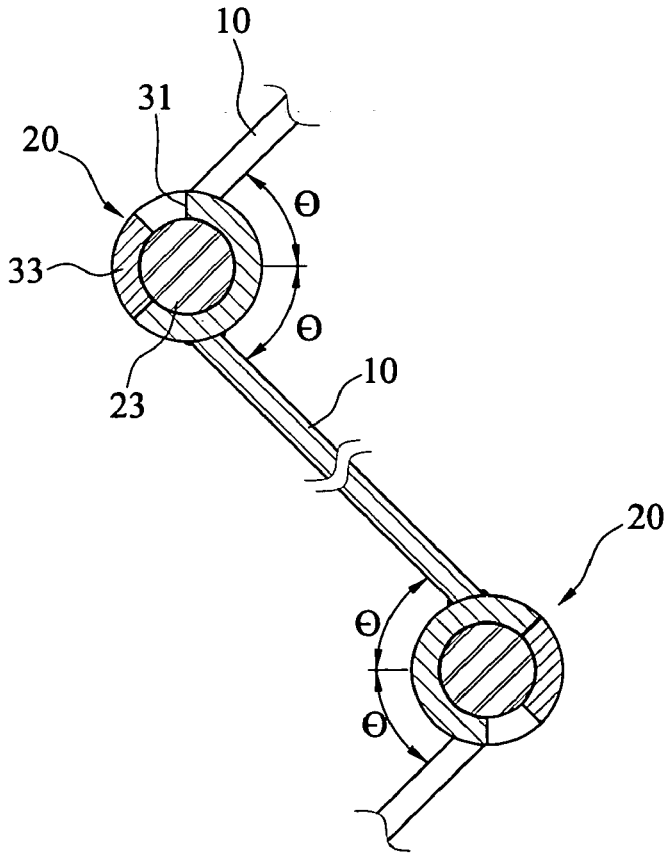
Figure 7A:
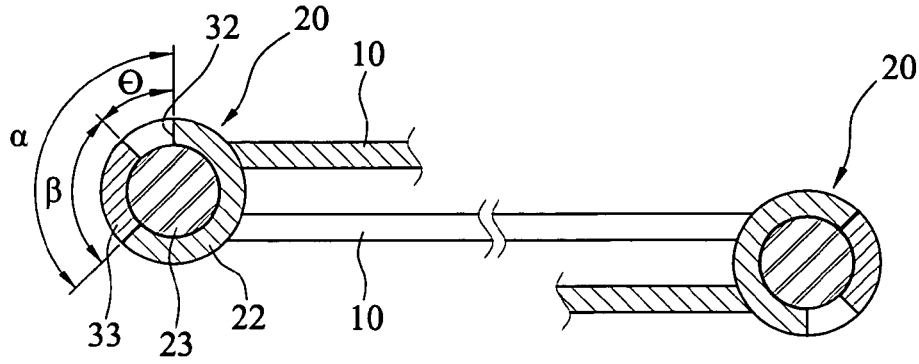
FIGS. 7A and 7B are sectional views showing a folding state and a spread state of the door leaves along line VII-VII of FIG. 5, respectively.
Figure 7B:
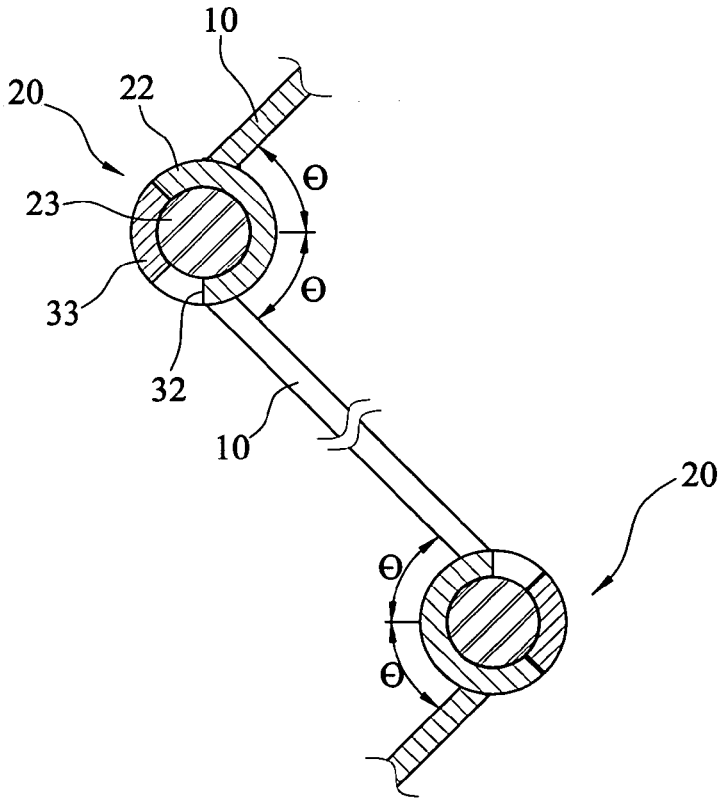
Figure 8A:
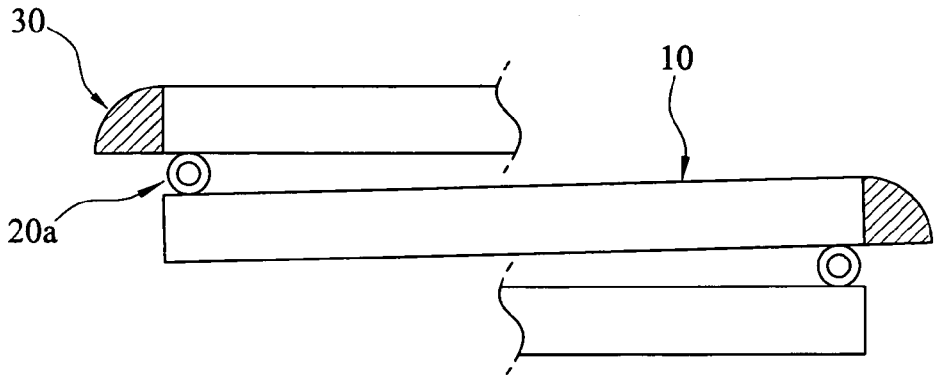
FIGS. 8A, 8B are top plan views illustrating a folding state and a spread state of a spread confining means according to a second embodiment, respectively.
Figure 8B:
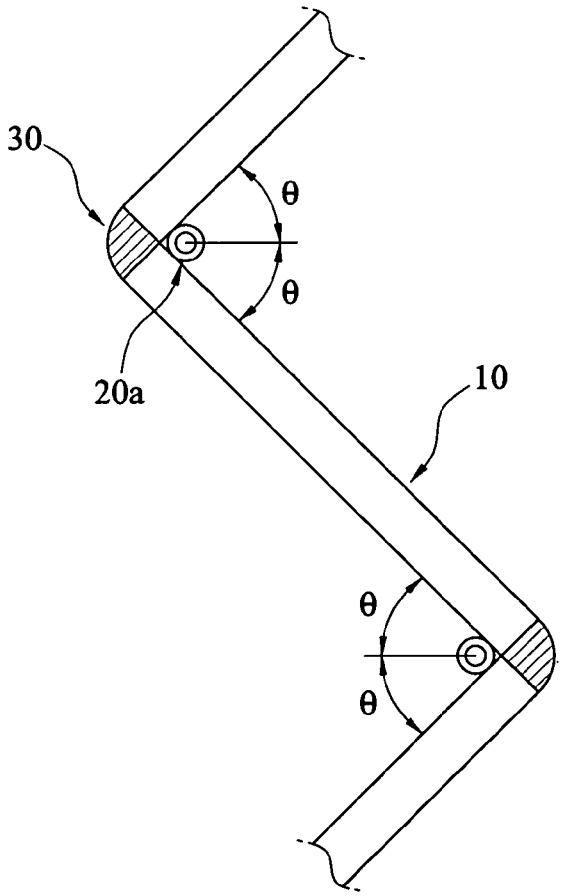

This invention will be described in further detail by way of exemplary embodiments with reference to the accompanying drawings.

As shown in FIGS. 1 to 4, the inventive half spread folding door is fundamentally comprised of plural door leaves 10 having a predetermined width and length door frames F supporting each door leaf 10 in both side ends thereof, a hinge means 20 for connecting successively each door leaf 10 to be rotated around a hinge shaft 23 correlatively, and folding each door leaf 10 sequentially, and a spread confining means 30 for limiting a spread range of each door leaf in a predetermined angle to configure as the form of zigzag when the door leaves 10 are spread.

The door leaf 10 is for example made by metal sheet or metal structure having a predetermined form, such as slab. The structure of the door leaf 10 can be selected with a consideration of its weight and strength etc.

Accordingly, in the present invention, the spread angle 30° (of which the spread effect is more than ½) and the spread angle 60° (of which an effect against an external force is more than ½) are adopted as the preceding angle and the following angle of 45°, the spread angle θ is established as 30° to 60°.

In the hinge means 20, any form can be acceptable that the hinge means 20 can be connected a door leaf 10 with an adjacent door leaf 10 and allowed each door leaf 10 to be rotated correlatively. For instance, a conventional hinge can be adapted which is comprised of a pair of hinge brackets having sleeves disposed alternatively at one end of each bracket to be fixed on a pair of door leaves 10; and a hinge pin inserted a hole formed by a coupling of the sleeves. Otherwise, in FIG. 4, the hinge means 20 can be configured which is comprised of first and second hinge cylinders 21, 22 welded on each end of door leaf 10 in coaxial position, and a hinge shaft 23 inserted into both hinge cylinders 21, 22.

In the case that the hinge means 20 is configured with a pair of hinge cylinders 21, 22 and the hinge shaft 23, it is desirable that each pair of hinge means 20 can be installed along the end of door leaf in a proper interval considering the height of the door leaf.

Many methods can be adapted to restrict the spread range of the spread confining means 30. For example, a first method is limiting itself's rotation angle of the hinge means 20. A second method is that using a rope etc. which connects the facing end of each door leaf coupled by the hinge means 20.

First, looking at the limit configuration of the rotation angle of the hinge means 20, as shown in FIGS. 4 to 7B, at a lower portion of the first hinge cylinder 21 is provided a first notch 31 that has a form of a cut-off in a predetermined angle around an axis of the first hinge cylinder 21. In the same way, at an upper portion of the second hinge cylinder 22 is provided a second notch 32 that has a form of a cut-off in a predetermined angle around an axis of the second hinge cylinder 22. The notch angle of both first and second hinge cylinders 21, 22 is the same one, but each cut-off portion can be overlapped in only a certain value.

Further, on a circumference of the hinge shaft 23 is provided by welding, etc. a stopper 33 that is nested in the overlap portion of the first and second notches 31, 32. Both side ends of the stopper can be in contact with the cut-off wall of notches 31, 32 selectively, thus restricting a rotation of each door leaf 10.

That is, the stopper 33 is attached on the circumference of the hinge shaft 23 that is exposed through the overlap portion of the first and second notches 31, 32 when the first and second hinge cylinders 21, 22 are coupled with the hinge shaft 23.

The pair of door leaves 10 can be rotated in the opposite direction at a spread angle θ of the first and second notches 31, 32 which is a value that subtracts an overlap angle β from a cut-off angleα of the notches 31, 32. Therefore, the half spread folding door has a form of zigzag, even in the fully spread position of the half spread folding door.

Figure 9A:
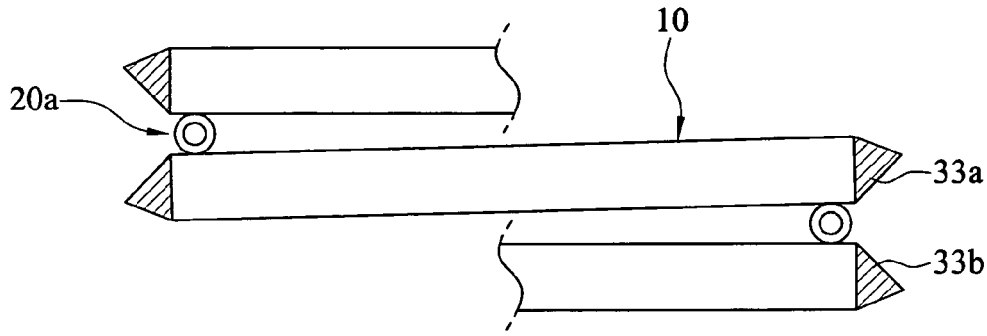
FIGS. 9A, 9B are top plan views illustrating a folding state and a spread state of a spread confining means according to another type of a second embodiment, respectively.
Figure 9B:
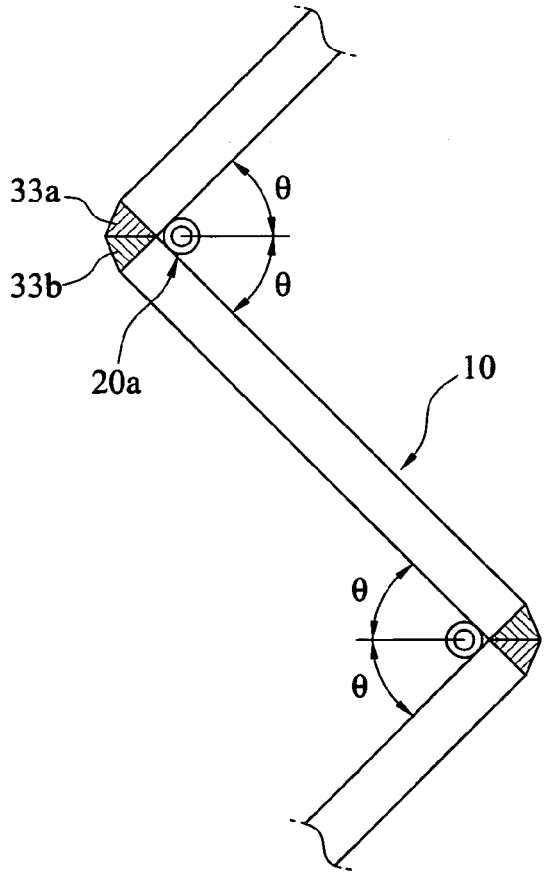

Next, as another method of the restriction of the door's rotation angle, as shown in FIGS. 8A to 9B, the adjacent ends of each door leaf 10 are connected by a hinge 20*a*. The stopper 33 can be attached by welding, etc. to either right or left hinge end of the door leaf 10 (FIGS. 8A and 8B), otherwise, a pair of stop elements 33*a*, 33*b* can be attached to each hinge end of the door (FIGS. 9A, 9B).

The stopper 33 or stop elements 33*a*, 33*b* are configured as a single bar so as to correspond a height of the door leaf 10, or as multiple members each having a proper length disposed along a height of the door in a predetermined space.

In the above-mentioned embodiments, a structure and installation of the spread confining means is very simple, and it is adaptable to a small door.

Figure 10:
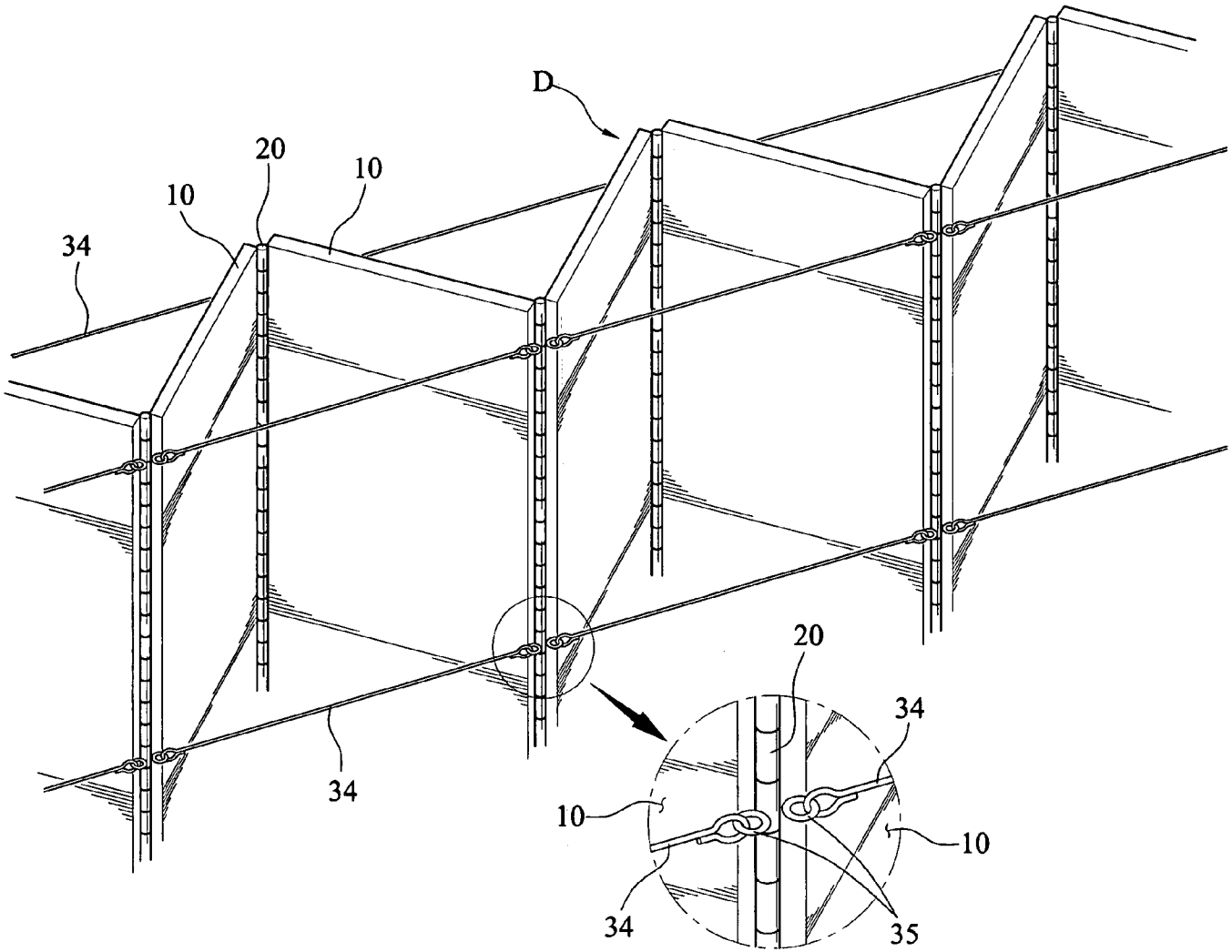
FIG. 10 is a perspective view showing a half spread folding door using a spread confining means according to a third embodiment.
Figure 11A:
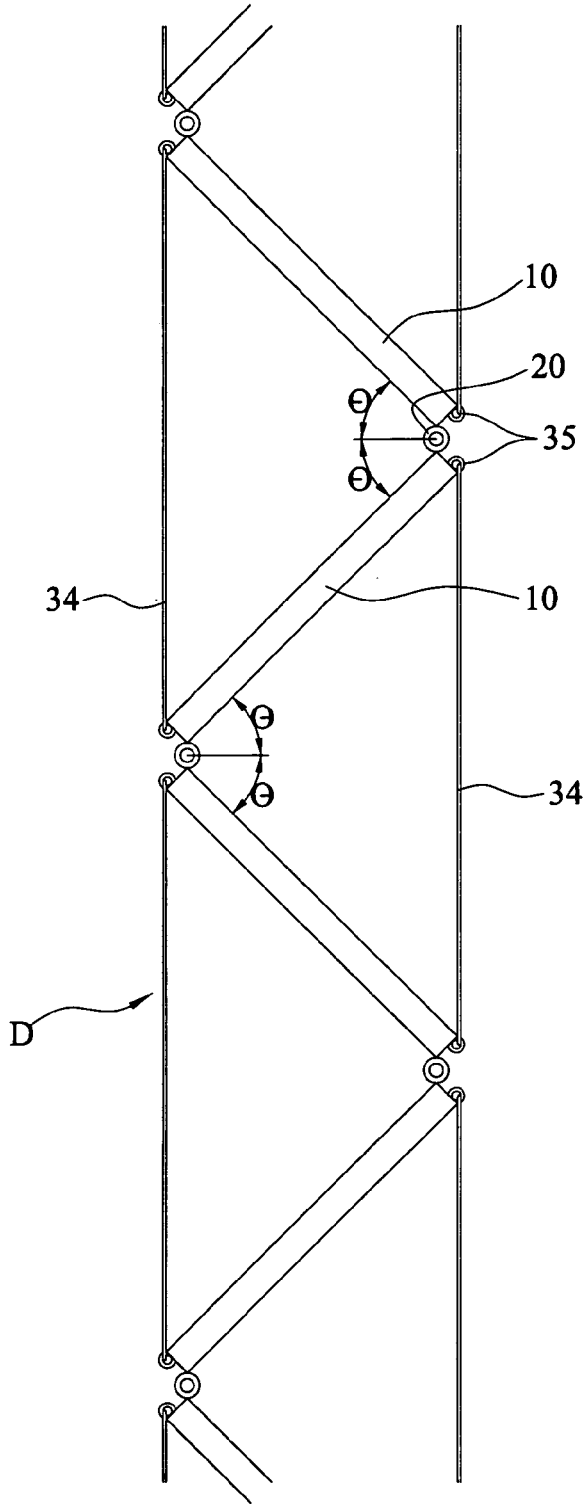
FIGS. 11A and 11B are top plan views illustrating operation state of a spread confining means according to a third embodiment.
Figure 11B:
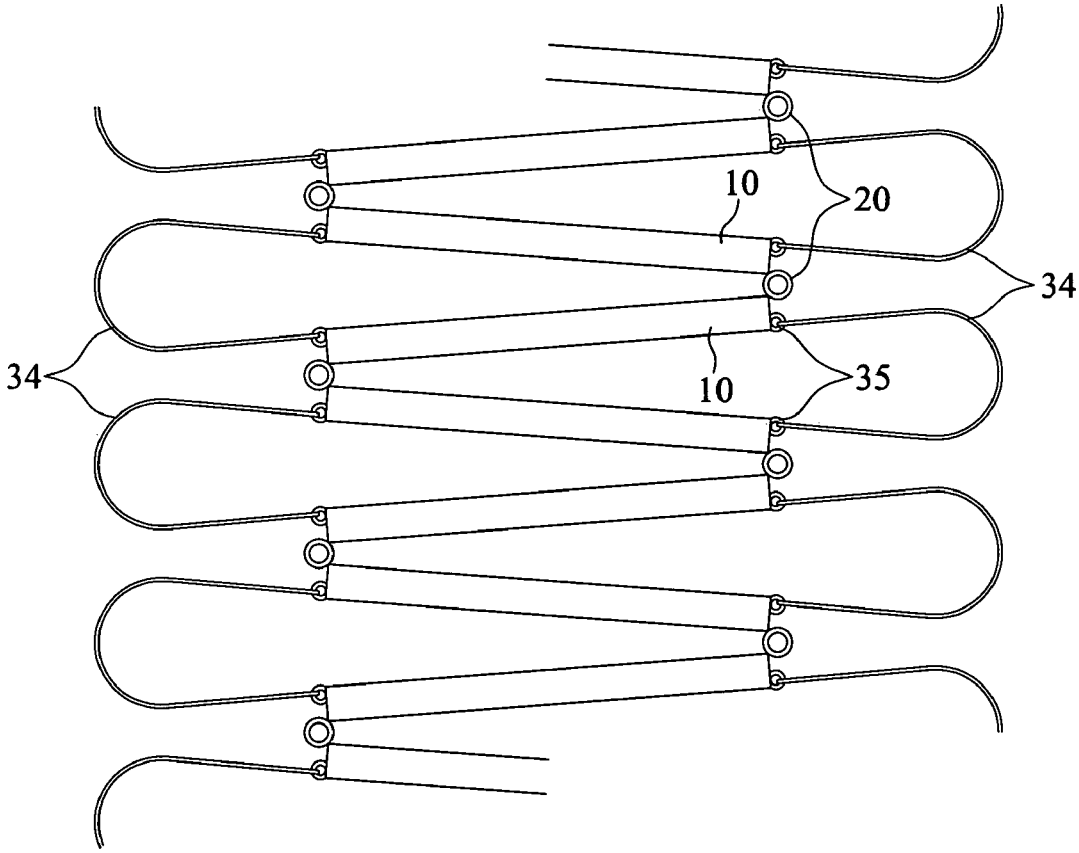

On the other hand, looking at a configuration for confining the range of a full spread of the door leaf 10 coupled with each other's end by hinge means 20, as shown in FIGS. 10 and 11, each end of a pair of door leaves 10 is connected with each other using a flexible wire or rope 24 having a predetermined length. Thus, each connected end of the door leaf 10 can spread away at an angle corresponding to a length of the rope 34.

A loop 35 is provided at the hinge means 20 of each door leaf 10, and each end of the rope is connected to the loop 35. A spread angle of a pair of half spread folding door leaves 10 is dependent on a length of the rope 34. The rope 34 is installed along the longitudinal direction of the door leaf 10 in a predetermined distance.

Figure 12:
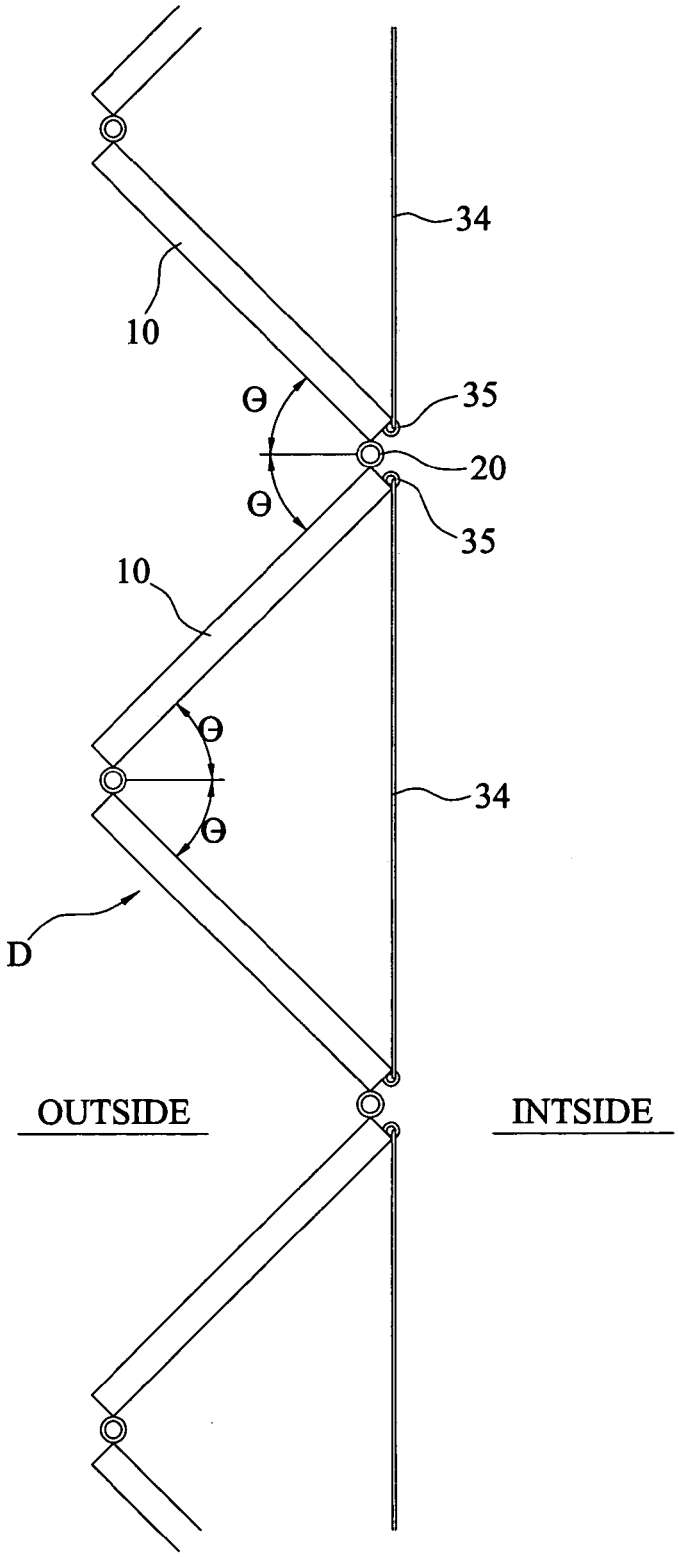
FIG. 12 is top plan views of a spread confining means according to another type of a third embodiment.

Also, the rope 34 can be connected to adjacent end facing toward both the outside and the inside of the door leaf 10 (FIG. 10), otherwise, only the inside of the door leaf 10 (FIG. 12). However, it may be possible to connect only the outside of the door leaf 10.

Figure 13:
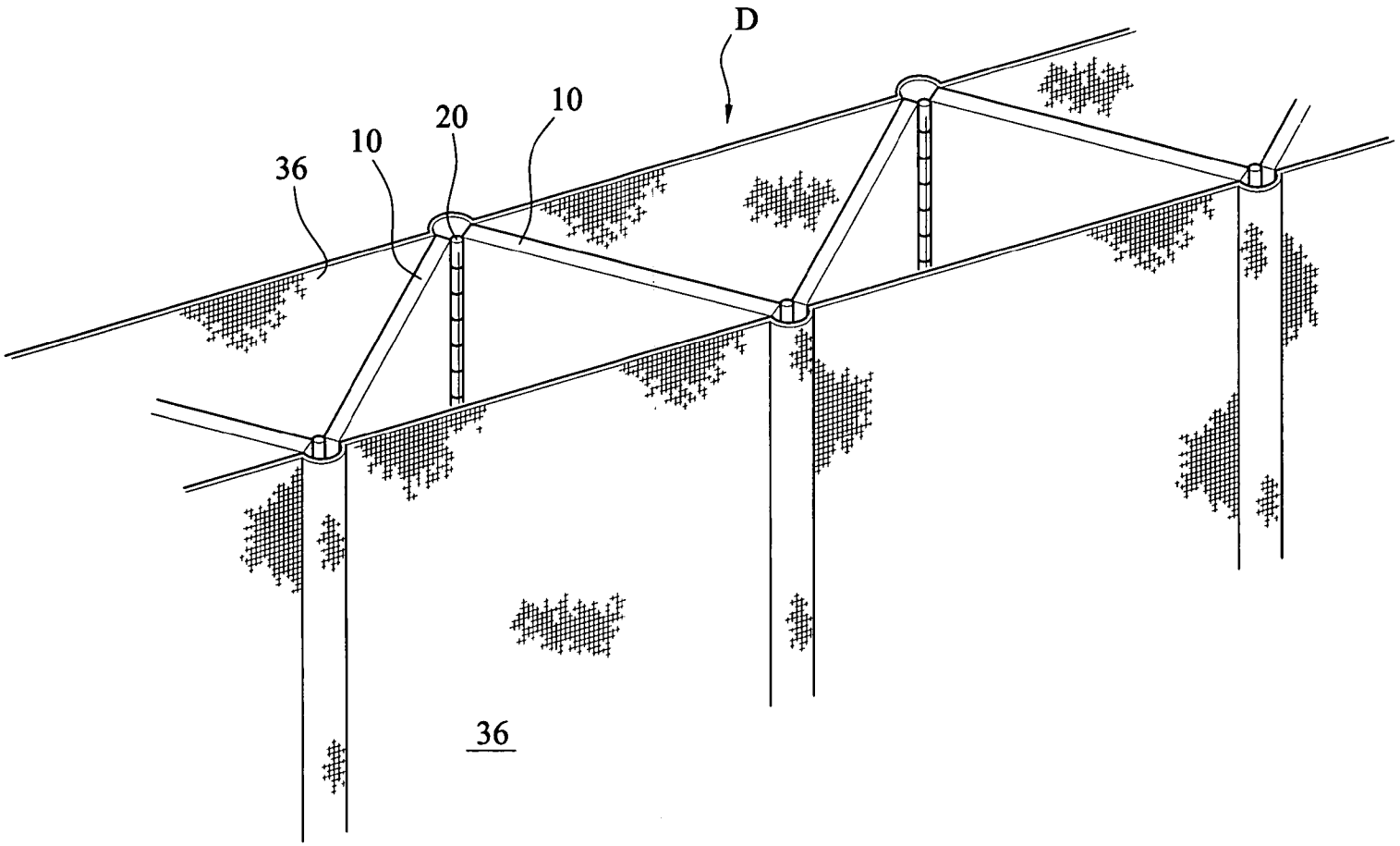
FIG. 13 is a perspective view showing a half spread folding door using a spread confining means according to a forth embodiment.

FIG. 13 illustrates the configuration that confines a spread range of free ends of a pair of door leaves 10 coupled by a sheet 36 instead of the above mentioned wire or rope 34. The sheet 36 has a configuration such that each end of the door leaf 10 is connected individually to the sheet 36 as the above rope 34 does. Preferably, as shown in the drawing, the sheet 36 is configured as the form of a single body, which connects in a predetermined space all ends of successive coupled door leaves 10, thus confining a spread range of the door.

The sheet connection has a nicer appearance than the rope connection, and also, it effectively prevents penetration of rain into an inside of a structure such as a warehouse. It is preferable that the sheet 36 is made by high tensile synthetic waterproof material.

The sheet 36 also is not illustrated in an individual drawing, but it is sure that the sheet 36 connects the ends facing toward at least one side of the folding door leaf 10.

Figure 14A:
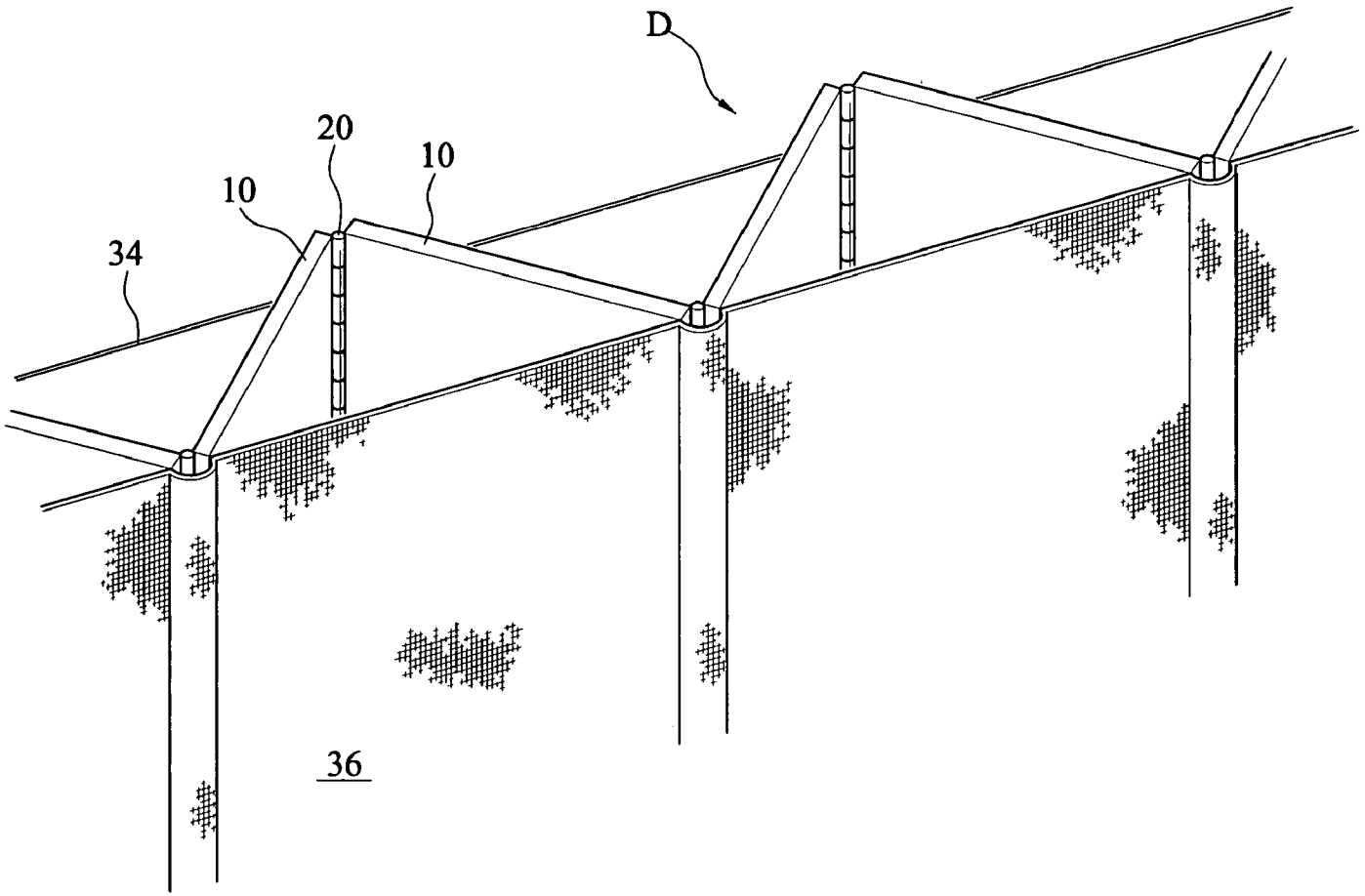
FIGS. 14A and 14B are a perspective view and a top plan view showing a half spread folding door using a spread confining means according to a fifth embodiment, respectively.
Figure 14B:
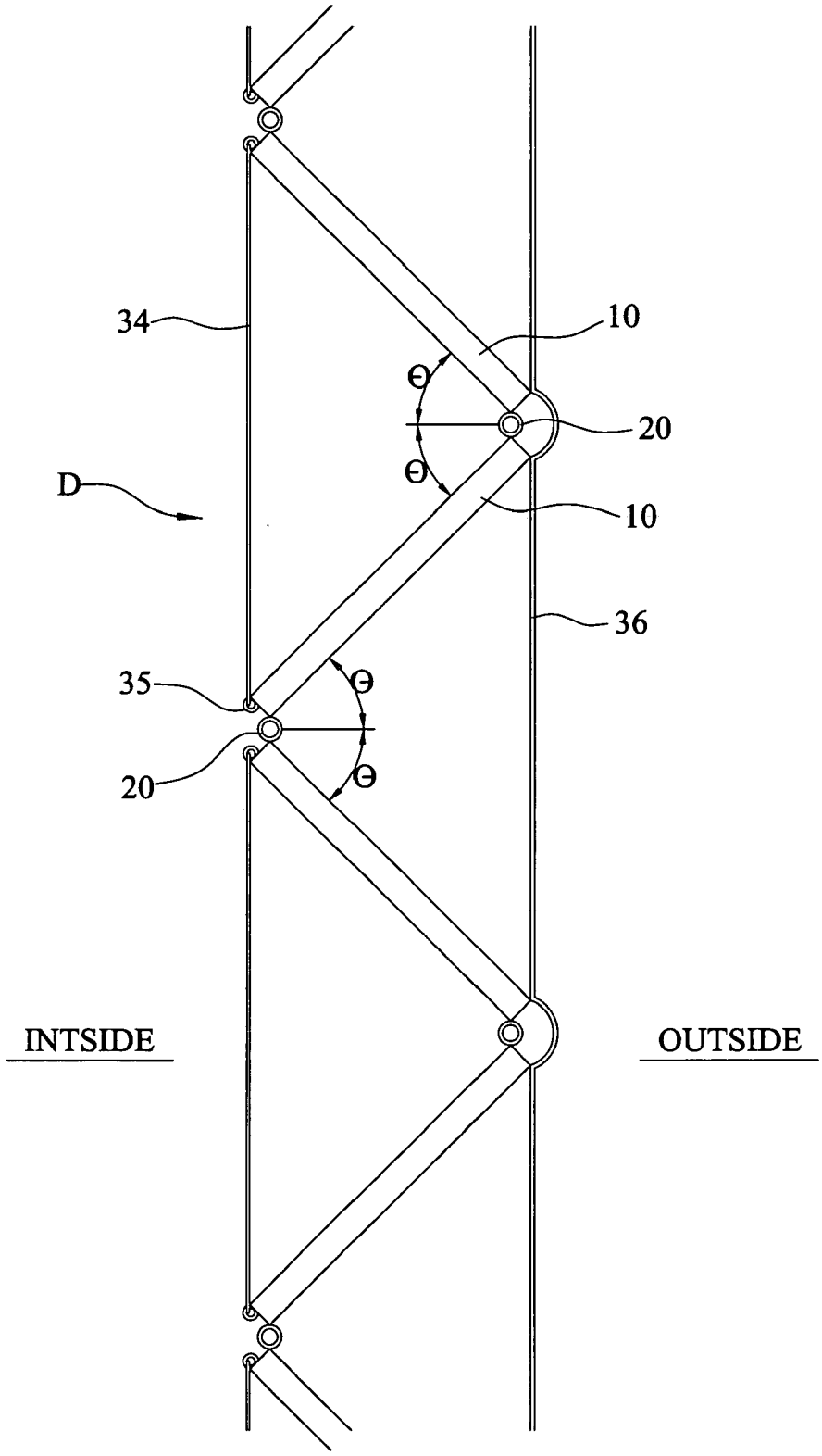

Furthermore, FIGS. 14A and 14B illustrate the configuration that confines a spread range of free ends of a pair of door leaves 10 using both the rope 34 and the sheet 36. In the drawing, the rope 34 is provided at the inside of the door leaf 10, while the sheet 36 is provided at the outside of the door leaf 10. This configuration is for a consideration of the door's appearance.

In the half spread folding door of the present invention, the spread angle θ of the door leaf 10 is an important factor depending on a rigidity and a spread effect of the door, and it will be described in further detail.

Figure 15:
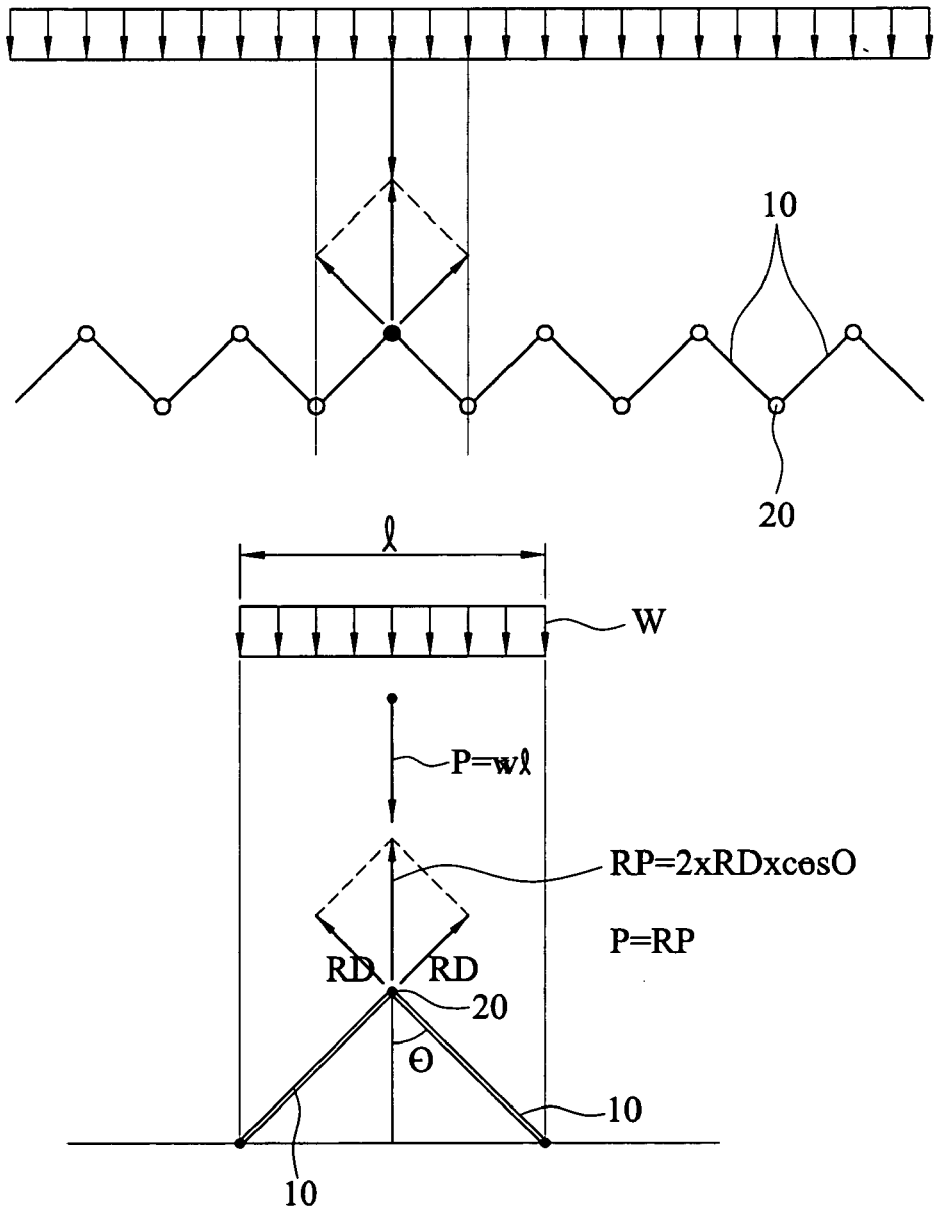
FIG. 15 is a conceptual view illustrating a resistance of a half spread folding door to a load according to the present invention.

In FIG. 15, assuming that the force of the wind is a uniform distribution load, the formula $P=w\times l$ is applied to calculate a sum of an external force applied to a pair of the door leaves 10 coupled by the hinge means 20. Further, the formula $RP=2\times RD\times\cos\theta$ is adapted to calculate a sum of an internal force applied to a pair of the door leaves 10 coupled by the hinge means 20.

Where P is a sum of an external force, w is a load applied on a unit area, l is a length between free ends of a pair of door leaves 10 coupled by a hinge, RP is a sum of an internal force against the external force, RD is an internal force of each door leaf, and θ is a spread angle of one door leaf.

Therefore, since an effect against an external force is proportional to cos θ, the smaller an spread angle θ of the door leaf 10, the better the effect. But, since an effect of the door's spread is proportional to sin θ, the larger an spread angle θ of the door leaf 10, the better the effect. If the spread angle θ is minified to heighten a rigidity of the door, the effect of the spread is lessened and the number of the door leaves must be added. On the contrary, if the spread angle θ is maximized to heighten an effect of the spread, the number of the door leaves can be reduced but a rigidity of the door leaf is lessened. Therefore, it is very desirable that the spread of the angle be established as 45°.

In the present half spread folding door having the above structural characteristic, a roller (not shown) can be adapted at a horizontal side of the door leaf 10 to run on a guide rail, thus enabling the door leaf 10 to be spread or folded easily.

Using the spread confining means of the half spread folding door, each door leaf cannot spread fully, but can spread within a predetermined angle, making a form of zigzag even when in a closing state. Therefore, the door has more rigidity in a whole than a conventional door in which the door leaves should be fully spread when in door's closing. Thus, the rigidity, having enough resistance to an external force, can be attained even if the door has a thin thickness.

Further, since each door leaf 10 maintains a folding state in a predetermined angle when the door leaf is also fully spread, the door can be easily opened with a little force, and also the smooth closing of door can be attained.

There requires only an installation area corresponding to a width of a door leaf, irrespective of a size of opening or the number of door leaves. This leads to a minimization of the installation area of the door, and a beautiful appearance of the door.

According to the inventive half spread folding door described above, since each door leaf has a form of zigzag even if the doors are fully spread, a thinner thickness door than a conventional flat type folding door can be configured using the same property material, which attains the very lighter but highly rigid door.

Further, the present invention has an effect in that since each door leaf can not fully spread, the door can be easily opened/closed with little force and also the door leaves can be smoothly folded when its opening operation, which adapts to use an opening of large structure or a foldable roof such as large depot and an airshed, etc.

Further, the present invention has an excellent effect in that structural stability and an improvement in confidence can be contributed.

What is claimed is:

1. A half spread folding door comprising:

plural door leaves having a predetermined width and length;

a first hinge comprising:

a hinge shaft, a first hinge cylinder and a second hinge cylinder, for connecting successively each door leaf with adjacent door leaves along its width direction;

a pair of said first hinges, each mounted lengthwise in side ends of each door leaf;

wherein the first hinge cylinder is established at one side end of the door leaf and enabling the hinge shaft to go through, and having a first notch at a lower portion of the first hinge cylinder, the first notch having a form of a cut-off in a predetermined angle around an axis of the first hinge cylinder; and wherein the second hinge cylinder is established at an adjacent side end of the adjacent door leaf to the door leaf and enabling the hinge shaft to go through, and having a second notch at an upper portion of the second hinge cylinder, the second notch having a form of a cut-off in a predetermined angle around an axis of the second hinge cylinder, the angle being the same as one of the first notch, but overlapping in only certain value;

plural second hinges having first and second hinge cylinders mounted lengthwise in the middle of adjacent door leaves, allowing each door leaf to be rotated around the hinge shaft correlatively, and for folding each door leaf toward alternative dead end of the door leaves sequentially; a spread confining mans for limiting relative rotation angles of every door leaf interconnected by the hinge means; and a stopper attached on a circumference of the hinge shaft to nest in the overlap portion, restricting the rotation of each door leaf coupled with the hinge shaft.

2. A half spread folding door comprising:

plural door leaves having a predetermined width and length;

a first hinge means for connecting successively each door leaf with adjacent door leaves along its width direction, wherein the first hinge means comprises a pair of hinges, each mounted lengthwise in side ends of each door leaf;

plural second hinges mounted lengthwise in the middle of each door leaf, allowing each door leaf to be rotated around a hinge shaft correlatively, and for folding each door leaf toward alternative dead end of the door leaves sequentially; a spread confining mans for limiting relative rotational angles of every door leaf interconnected by the hinge means; and a sheet which connects with each end of the door leaves coupled with the hinge shaft, all connected ends facing toward at least one side of the folding door.

3. The half spread folding door as set forth in claim 2, wherein the sheet is configured as the form of a single body that connects all ends of successive coupled door leaves.

4. The half spread folding door as set forth in claim 3, wherein the sheet is made by high tensile synthetic waterproof material.

5. A half spread folding door comprising:

plural door leaves having a predetermined width and length;

a first hinge means for connecting successively each door leaf with adjacent door leaves along its width direction, wherein the first hinge means comprises a pair of hinges, each mounted lengthwise in side ends of each door leaf;

plural second hinges mounted lengthwise in the middle of each door leaf allowing each door leaf to be rotated around a hinge shaft correlatively, and for folding each door leaf toward alternative dead end of the door leaves sequentially; and a spread confining means for limiting relative rotational angles of every door leaf interconnected by the hinge means and a spread range of each door leaf in a predetermined angle to configure as the form of zigzag when the door leaves are spread, wherein the spread confining means is comprised of a sheet which connects with each end of the door leaves coupled with the hinge shaft, all connected ends facing toward the outside of the folding door; and a flexible wire or rope having a predetermined length which connects with each end of the door leaves coupled with the hinge shaft, all connected ends facing toward the inside of the folding door.

6. The half spread folding door as set forth in claim 5, wherein the sheet is configured as the form of a single body that connects all ends of successive coupled door leaves and is made by high tensile synthetic waterproof material.

* * * * *